US007816864B2

(12) United States Patent
Liang et al.

(10) Patent No.: US 7,816,864 B2
(45) Date of Patent: Oct. 19, 2010

(54) DOUBLE-SHIELDED ELECTROLUMINESCENT PANEL

(75) Inventors: Chih Ping Liang, Hsinchu (TW); Huei Pin Huang, Taoyuan (TW)

(73) Assignee: CeeLite, Inc., Blue Bell, PA (US)

( * ) Notice: Subject to any disclaimer, the term of this patent is extended or adjusted under 35 U.S.C. 154(b) by 404 days.

(21) Appl. No.: 11/058,606

(22) Filed: Feb. 16, 2005

(65) Prior Publication Data

US 2005/0275347 A1 Dec. 15, 2005

(30) Foreign Application Priority Data

Jun. 9, 2004 (TW) ..... 93209082 U

(51) Int. Cl.
*H05B 33/26* (2006.01)

(52) U.S. Cl. ..... 313/512

(58) Field of Classification Search ..... 313/498–512; 315/169.3; 345/36, 45, 76
See application file for complete search history.

(56) References Cited

U.S. PATENT DOCUMENTS

| | | | | |
|---|---|---|---|---|
| 2,908,806 | A | 10/1959 | Cohen | |
| 3,056,897 | A | 10/1962 | Knochel et al. | |
| 3,548,254 | A | 12/1970 | Pahlavan | |
| 3,566,391 | A | 2/1971 | Lally | |
| 3,573,532 | A | 4/1971 | Boucher | |
| 3,651,319 | A | 3/1972 | Norris et al. | |
| 3,694,645 | A | 9/1972 | Brantz | |
| 3,992,874 | A | 11/1976 | Collins | |
| 4,017,155 | A | 4/1977 | Yagi et al. | |
| 4,053,813 | A | 10/1977 | Kornumpf et al. | |
| 4,135,959 | A | 1/1979 | Luo et al. | |
| 4,144,557 | A | 3/1979 | Kerr, III et al. | |
| 4,161,018 | A | 7/1979 | Briggs et al. | |
| 4,214,296 | A | 7/1980 | Magett | |
| 4,284,317 | A | 8/1981 | Doyle | |
| 4,338,547 | A | 7/1982 | McCaslin | |
| 4,343,032 | A | 8/1982 | Schwartz | |
| 4,500,173 | A * | 2/1985 | Leibowitz et al. | 315/169.3 |
| 4,629,267 | A | 12/1986 | Stepan | |
| 4,823,240 | A | 4/1989 | Shenker | |
| 4,853,594 | A | 8/1989 | Thomas | |
| 4,857,013 | A | 8/1989 | Peters | |
| 4,943,886 | A | 7/1990 | Quazi | |
| 4,963,788 | A | 10/1990 | King et al. | |
| 5,083,065 | A | 1/1992 | Sakata et al. | |

(Continued)

FOREIGN PATENT DOCUMENTS

| | | |
|---|---|---|
| WO | 2007/126737 | 11/2007 |

(Continued)

*Primary Examiner*—Nimeshkumar D Patel
*Assistant Examiner*—Christopher M Raabe
(74) *Attorney, Agent, or Firm*—Connolly Bove Lodge & Hutz

(57) ABSTRACT

A double-shielded electroluminescent panel includes an electroluminescent device, an upper electrical shield and a lower electrical shield. The upper electrical shield is a transparent conductive material, and is overlaid on the illuminating surface of the electroluminescent device. The lower electrical shield is an electrical conductive material, and is mounted on the non-illuminating surface of the electroluminescent device. The upper electrical shield and lower electrical shield are together connected to the ground line of a power source. Therefore, the occurrence of electromagnetic interference and an electric shock is avoided.

32 Claims, 4 Drawing Sheets

U.S. PATENT DOCUMENTS 5,128,595 A 7/1992 Hara
5,309,062 A 5/1994 Perkins et al.
5,337,224 A 8/1994 Field et al.
5,381,310 A 1/1995 Brotz
5,444,310 A 8/1995 Kataoka et al.
5,444,330 A 8/1995 Leventis et al.
5,493,182 A 2/1996 Sowa et al.
5,515,247 A 5/1996 Cheung et al.
5,525,870 A 6/1996 Matsuzawa et al.
5,550,433 A 8/1996 Tobler
5,552,009 A 9/1996 Zager et al.
5,563,473 A 10/1996 Mattas et al.
5,585,694 A 12/1996 Goldburt et al.
5,608,614 A 3/1997 Ohnishi et al.
5,608,715 A 3/1997 Yokogawa
5,638,339 A 6/1997 DeLoretto et al.
5,677,602 A 10/1997 Paul et al.
5,712,528 A 1/1998 Barrow et al.
5,732,979 A 3/1998 Finke
5,739,645 A 4/1998 Xia et al.
5,749,646 A 5/1998 Brittell
5,816,682 A 10/1998 Marischen
5,833,508 A 11/1998 Chien
5,836,671 A 11/1998 Chien
5,899,549 A 5/1999 Nakanishi et al.
5,902,688 A 5/1999 Antoniadis et al.
5,926,440 A 7/1999 Chien
5,965,980 A 10/1999 Hagiwara et al.
6,034,481 A 3/2000 Haynes
6,054,725 A 4/2000 Liedenbaum et al.
6,065,848 A 5/2000 Tucker et al.
6,072,445 A * 6/2000 Spitzer et al. ..... 345/8
6,082,867 A 7/2000 Chien
6,082,868 A 7/2000 Carpenter
6,100,478 A 8/2000 LaPointe et al.
6,106,135 A 8/2000 Zingale et al.
6,107,735 A * 8/2000 Hora ..... 313/506
6,136,632 A * 10/2000 Higashi ..... 438/166
6,144,156 A 11/2000 Lutschounig et al.
6,158,868 A 12/2000 Chien
6,160,346 A 12/2000 Vlegger
6,168,841 B1 1/2001 Chen
6,170,958 B1 1/2001 Chien
6,177,768 B1 1/2001 Kamata et al.
6,179,432 B1 1/2001 Zhang et al.
6,198,060 B1 3/2001 Yamazaki et al.
6,250,773 B1 6/2001 Lai
6,254,260 B1 7/2001 Wang et al.
6,265,043 B1 7/2001 Vinyard
6,271,631 B1 8/2001 Burrows
6,280,809 B1 8/2001 Wang et al.
6,302,559 B1 10/2001 Warren
6,326,735 B1 12/2001 Wang et al.
6,347,877 B1 2/2002 Douglass, II
6,456,342 B1 * 9/2002 Takenaka ..... 349/58
6,471,365 B2 10/2002 Wang et al.
6,513,951 B1 2/2003 Wang et al.
6,522,069 B1 * 2/2003 Hong et al. ..... 313/582
6,528,941 B1 3/2003 Inubushi et al.
6,545,232 B1 4/2003 Huo-Lu
6,554,442 B2 4/2003 Chou
6,561,671 B2 5/2003 Wang et al.
6,562,431 B2 5/2003 Wang et al.
6,601,964 B2 8/2003 Wang et al.
6,686,549 B2 2/2004 Douzono et al.
6,743,993 B1 6/2004 Clark et al.
7,057,125 B1 6/2006 Tsai
7,071,433 B2 7/2006 Holscher
7,148,937 B2 12/2006 Rankin, Jr. et al.
7,235,752 B1 6/2007 Chen et al.
2002/0068141 A1 6/2002 Pieper
2004/0113567 A1 6/2004 Yamauchi et al.
2005/0275347 A1 12/2005 Liang et al.
2006/0006818 A1 1/2006 Fishbein et al.
2006/0055346 A1 3/2006 Ohta et al.
2006/0055679 A1 3/2006 Grinshpoon et al.
2006/0087262 A1 4/2006 Kim et al.
2006/0261748 A1 11/2006 Nukisato et al.
2007/0247085 A1 10/2007 Yao et al.

FOREIGN PATENT DOCUMENTS

WO 2007/126738 11/2007
WO 2007/126739 11/2007

* cited by examiner

DOUBLE-SHIELDED ELECTROLUMINESCENT PANEL

BACKGROUND OF THE INVENTION

1. Field of the Invention

The present invention relates to a double-shielded electroluminescent panel, more particularly to an electroluminescent panel against current leakage and electromagnetic interference.

2. Description of the Related Art

The great progress in electroluminescent device manufacturing has led to a rather large increase in the brightness of an electroluminescent device. In this regard, the electroluminescent device is capable of acting as the backlight source of a large-scale outdoor signboard such as a signboard with an area of from 60×90 $cm^2$ to 100×140 $cm^2$. Generally speaking, a user can control the operation voltage and alternating frequency of the electroluminescent device to change its brightness, wherein the range of the operation voltage is from 6V to 220V and the range of the alternating frequency is from 50 Hz to 1,500 Hz. The adjustment of the operation voltage or the alternating frequency controls the brightness or hue of luminescence. 140 V accompanied with 1,200 Hz is a currently popular driving specification for the driving power source of the electroluminescent device.

FIG. 1 is a schematic cross-sectional diagram of a conventional electroluminescent device. The electroluminescent device comprises an upper insulation layer 11, a front electrode layer 12, a fluorescence layer 13, a dielectric layer 14, a back electrode layer 15 and a lower insulation layer 16. The fluorescence layer 13 emits fluorescent rays through the upper insulation layer 11 after being excited by electrical energy. Therefore, the upper insulation layer 11 is the illuminating surface of the electroluminescent device 10. The front electrode layer 12 is made from a transparent ITO (Indium Tin Oxide) material, and the back electrode layer 15 is formed by coating or printing silver or carbon paste on the dielectric layer 14.

The electroluminescent device 10 applied to a large-scale signboard is generally fixed to the surface a metal plate or a metal frame. The metal plate is erected at an arresting place for public display. Because the environment moisture becomes higher or the dielectric coefficient of the lower insulation layer 16 is large enough, stray capacitors exist between the electroluminescent device 10 and the metal plate and result in current leakage.

FIG. 2 is an explanatory diagram illustrating current leakage and an electric shock occurring in the application of a conventional electroluminescent device. The electroluminescent device 10 is fixed to a metal plate 21, supplied with electrical power from an electrical source, and connected to an indoor socket 80 through an inverter 22. The common socket 80 includes three insertion holes respectively of a live line 81, a neutral line 82 and a ground line 83. In comparison with the socket 80, the inverter 22 has two plug terminals 221 and 222 connected to the neutral line 82 and live line 81, respectively. Because stray capacitors 231 exist between the electroluminescent device 10 and metal plate 21, electric charges accumulate on the surface of the metal plate 21. When a voltmeter is used to measure the voltage between the metal plate 21 and ground line 83, a considerable voltage difference exists between them. When a person touches the metal plate 21, he gets an electric shock caused by an electric current through his body. If the area of the electroluminescent device 10 is over 1,000 $cm^2$, the driving source of it is set to the specification of 140V and 1,200 Hz so the voltage between the metal 21 and ground line 83 is higher than 1,000V. Meanwhile, a stray capacitor 231 exists in the inverter 22, hence the person touching the metal plate 21 would be a part of the circuit loop.

The structure of the conventional electroluminescent device 10 is too simple to be free from the danger of an electric shock. U.S. Pat. Nos. 5,899,549 and 6,528,941 respectively disclose an electroluminescent device with a lower shield layer that protects the components attached to the backside of the electroluminescent device from electromagnetic interference.

The electroluminescent device is a planar light source, and can display a large-scale image. When the specification of the driving source is 140V and 1,200 Hz, numerous electromagnetic waves are radiated from the illuminating surface. In this regard, the operation environment of reduced electromagnetic radiation does not comply with this fact.

In summary, an electroluminescent combination is in an urgent need of avoiding current leakage for the electroluminescence market to overcome the aforesaid problems.

SUMMARY OF THE INVENTION

The primary objective of the present invention is to provide a double-shielded electroluminescent panel. The leakage current is led to a ground or earth through its two electrical shield. Therefore, when a person touches the metal plate supporting the electroluminescent device, there is no danger of an electric shock due to the current passing through his body.

The second objective of the present invention is to provide an electroluminescent panel free from electromagnetic interference. The interference of exterior electromagnetic waves is isolated from the electroluminescent panel by two electrical shields. Furthermore, the electromagnetic radiation generated from the electroluminescent panel is also absorbed by the shields so as not to be emitted to the exterior.

In order to achieve the objective, the present invention discloses double-shielded electroluminescent panel. The double-shielded electroluminescent panel comprises an electroluminescent device, an upper electrical shield and a lower electrical shield. The upper electrical shield is a transparent conductive material, and is overlaid on the illuminating surface of the electroluminescent device. The lower electrical shield is an electrical conductive material, and is mounted on the non-illuminating surface of the electroluminescent device. The upper electrical shield and lower electrical shield are together connected to the ground line of a power source. Therefore, the occurrence of electromagnetic interference and an electric shock is avoided.

Moreover, a flexible buffer material is used to combine the lower electrical shield with the electroluminescent device to absorb the vibration generated from the electroluminescent device. Similarly, a flexible buffer adhesive is used to adhere the upper electrical shield to the electroluminescent device, hence the vibration behavior cannot transmit from the illuminating surface to the exterior.

BRIEF DESCRIPTION OF THE DRAWINGS

The invention will be described according to the appended drawings in is which.

PREFERRED EMBODIMENT OF THE PRESENT INVENTION

Figure 1:
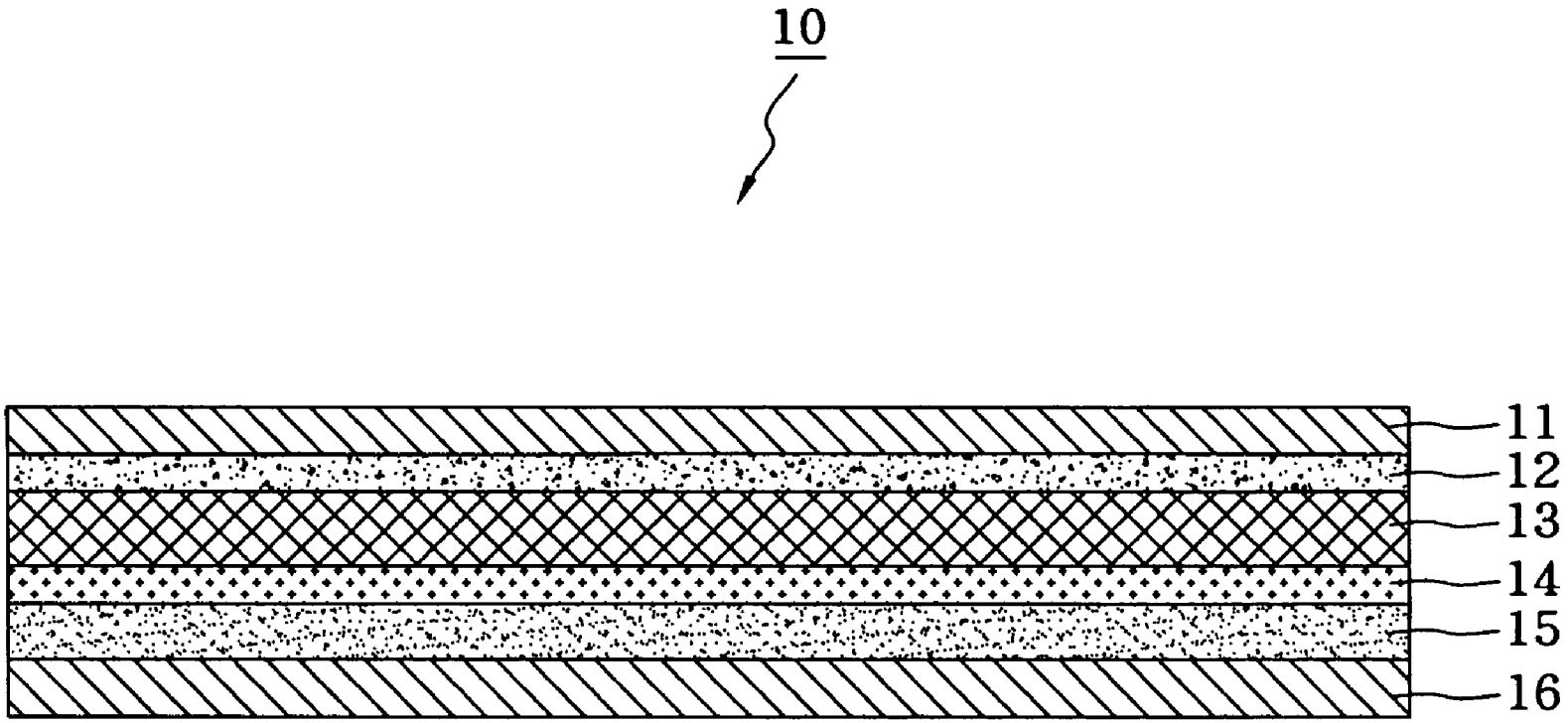
FIG. 1 (Background Art)
FIG. 1 is a schematic cross-sectional diagram of a conventional electroluminescent device.
Figure 2:
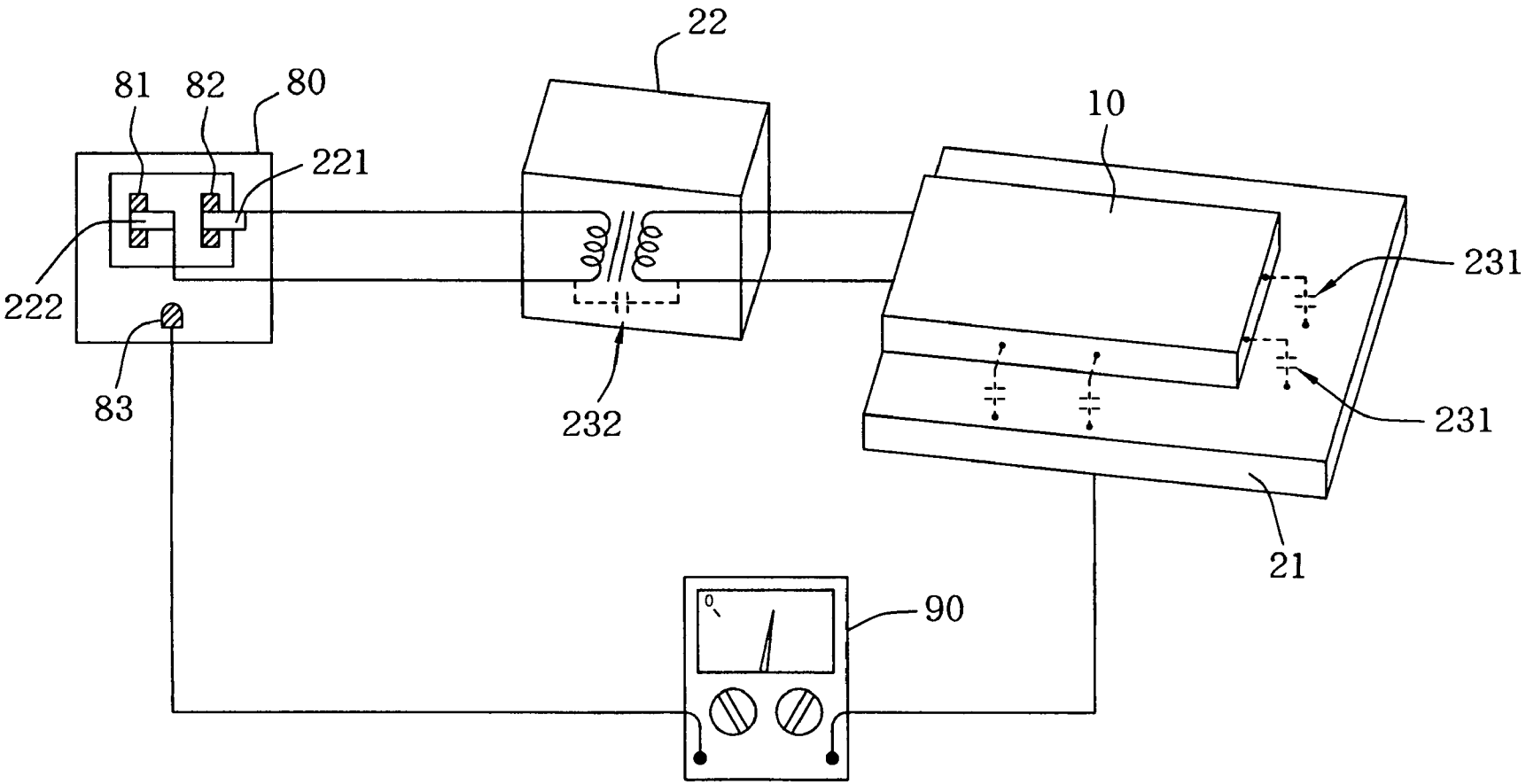
FIG. 2 (Background Art)
FIG. 2 is an explanatory diagram illustrating current leakage and an electric shock occurring in the application of a conventional electroluminescent device.
Figure 3:
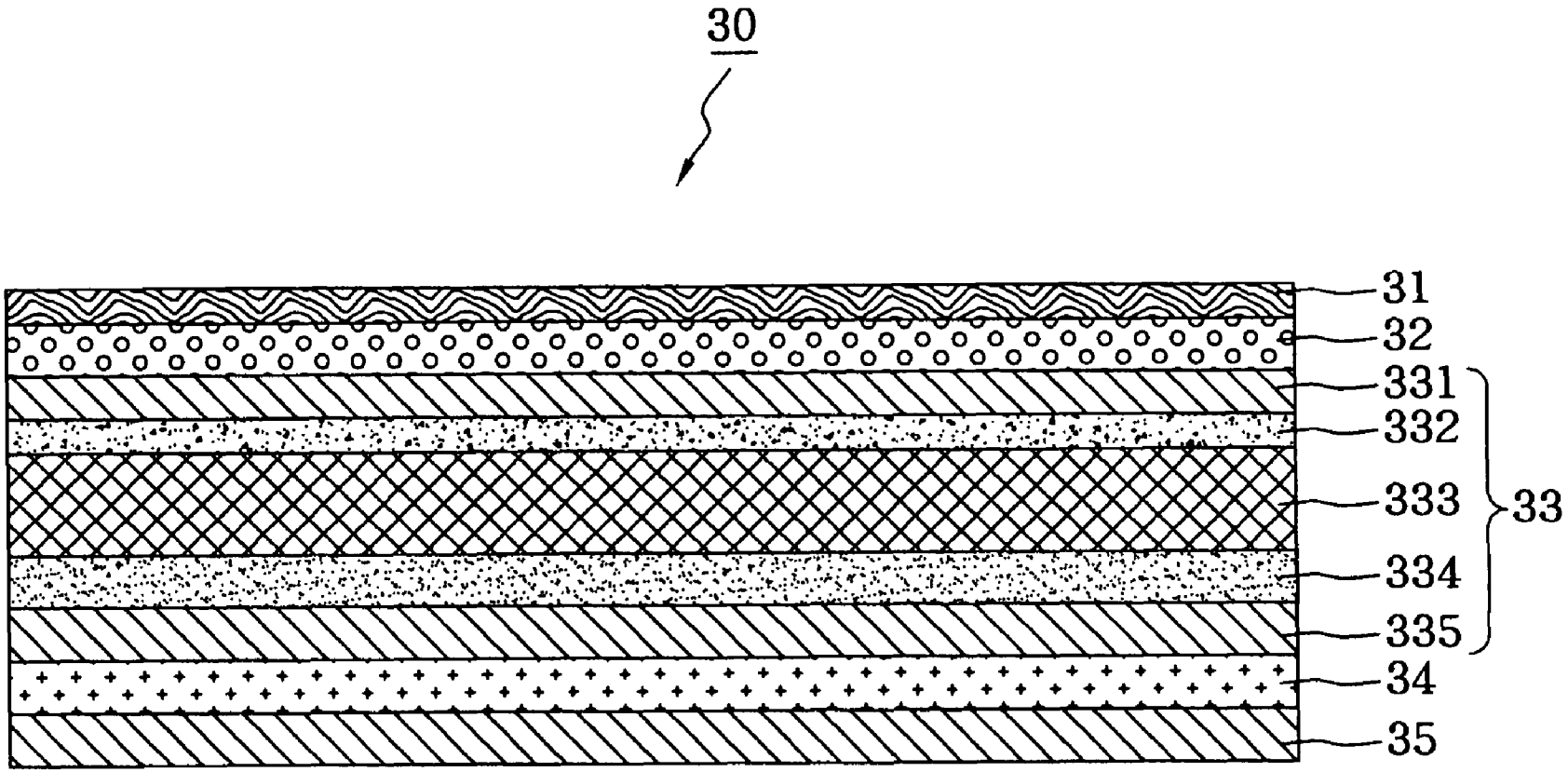
FIG. 3 is a schematic cross-sectional diagram of a double-shielded electroluminescent panel in accordance with present invention.

FIG. 3 is a schematic cross-sectional diagram of a double-shielded electroluminescent panel in accordance with present invention. The double-shielded electroluminescent panel 30 comprises an electroluminescent device 33, an upper electrical shield 32 and a lower electrical shield 34. The upper electrical shield 32 is a transparent conductive material such as ITO and an organic conductive high polymer, and is overlaid on the electroluminescent device 33. The lower electrical shield 34 is made from a conductive material such as a thin metal (aluminum, iron, etc.) plates and silver or carbon paste that is coated by printing on the non-illuminating surface of the electroluminescent device 33, wherein the non-illuminating surface is opposite to the illuminating surface.

The electroluminescent device 33 comprises an upper insulation layer 331, a front electrode layer 332, a fluorescence layer 333, a back electrode layer 334 and a lower insulation layer 335. The double-shielded electroluminescent panel 30 utilizes the upper insulation layer 331 to combine with the upper electrical shield 32, and the lower electrical shield 34 is also attached to it by the lower insulation layer 335. Furthermore, a transparent protection layer 31 is overlaid on the surface of the upper electrical shield 32 against any damage caused by scratches. Similarly, an insulator 35 covers the lower surface of the lower electrical shield 34 to allow it to withstand external force.

Figure 4:
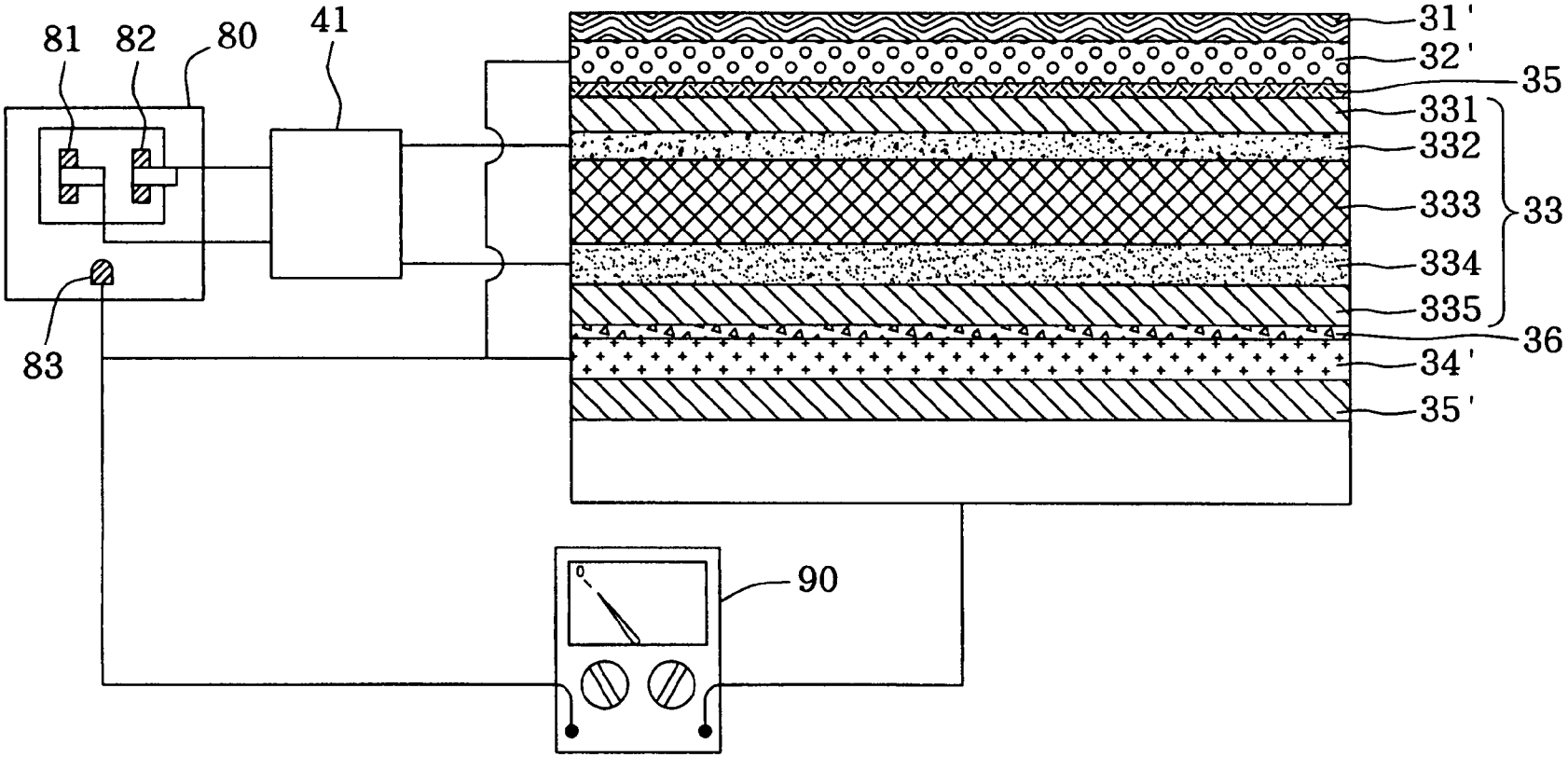
FIG. 4 is an explanatory diagram illustrating the application of an electroluminescent panel against an electric shock and electromagnetic interference in accordance with the present invention.

A dielectric layer (not shown) exists between the fluorescence layer 333 and back electrode layer 334. The dielectric layer is made from piezoelectric material such as $BaTiO_3$. When the electroluminescent device 33 supplied with electrical power starts to illuminate, the vibration behavior of the dielectric layer is induced by the stimulation of the electrical field. A flexible buffer adhesive 36 is used to combine the lower electrical shield 34' with the electroluminescent device 33 to absorb the vibration generated from the electroluminescent device 33, as shown in FIG. 4. On the other hand, a similar flexible buffer adhesive 35 is used to adhere the upper electrical shield 32' to the electroluminescent device 33, hence the mechanical waves cannot be transmitted from the illuminating surface to the exterior support frame. Instead of the flexible buffer adhesive 36, a sponge or a rubber coated with adhesive has the same shock absorption and connection function. For the sake of protecting the surfaces of the upper electrical shield 32 and lower electrical shield 34, a transparent protection layer 31' and an insulator 35' are also needed to cover the surfaces.

FIG. 4 is an explanatory diagram illustrating the application of an electroluminescent panel against an electric shock and electromagnetic interference in accordance with the present invention. The electroluminescent panel 30' is fixed to a metal plate 42, and is supplied with electrical power from an electrical source, connected to an indoor socket 80, through an inverter 41. The inverter 41 has two plug terminals 411 and 412 connected to the neutral line 82 and live line 81, respectively. After the inversion, the live line 81 is connected to the front electrode layer 332 and back electrode layer 334. Furthermore, the upper electrical shield 32' and lower electrical shield 34' are together connected to the ground line 83 of the socket 80, hence electric charges accumulating on them is swiftly lead to the ground.

If the electroluminescent panel 30' is applied to the body of a mobile vehicle, the upper electrical shield 32' and lower electrical shield 34' are together connected to its metal shell. Similarly, they are also coupled to the metal cover of a large-scale machine. When a voltmeter 90 is used to measure the voltage difference between the metal plate 42 and ground 83, the indication of it approaches zero. That is, when a person touches the metal plate 42, an electric shock caused from a leakage current or a discharge does not pass through his body.

On the other hand, because the upper electrical shield 32' and lower electrical shield 34' are together connected to the ground, they can absorb the electromagnetic radiation of the electroluminescent panel 30' and isolate the electromagnetic interference from the exterior. In conclusion, the present invention not only protects operators and workers from an electric shock, but also has an anti-EMI (electromagnetic interference) function.

The above-described embodiments of the present invention are intended to be illustrative only. Numerous alternative embodiments may be devised by persons skilled in the art without departing from the scope of the following claims.

What is claimed is:

1. A shielding apparatus for an electroluminescent light having a fluorescence layer, a dielectric layer, a plurality of electrodes, and an illuminating surface being capable of emitting luminescent rays responsively to application of an electrical potential across the plurality of electrodes, said apparatus comprising:

an upper electrical shield being a transparent conductive film with a contact grounded;

a lower electrical shield being a conductive film with a contact grounded;

wherein, the electroluminescent light is interposed between the upper electrical shield and the lower electrical shield, the electroluminescent light being capable of emitting luminescent rays through the upper electrical shield; and first and second flexible vibration buffers interposed between the electroluminescent light and the upper and lower electrical shields, respectively;

wherein, the electroluminescent light is a backlight source.

2. The shielding apparatus of claim 1, wherein the upper electrical shield and the lower electrical shield are together connected to a ground line of an electrical power source or grounded directly.

3. The shielding apparatus of claim 1, wherein the upper electrical shield and the lower electrical shield are together connected to a metal shell body of a vehicle or a large-scale machine.

4. The shielding apparatus of claim 1, wherein the lower electrical shield is a thin metal plate.

5. The shielding apparatus of claim 1, wherein the lower electrical shield is a silver paste layer or a carbon paste layer.

6. The shielding apparatus of claim 5, wherein the silver paste layer or the carbon paste layer is coated or printed on the electroluminescent device.

7. The shielding apparatus of claim 1, wherein the upper electrical shield is an ITO or an organic conductive high polymer.

8. The shielding apparatus of claim 1, further comprising a transparent protection layer overlaid on the upper electrical shield.

9. The shielding apparatus of claim 1, further comprising an isolator formed on the lower electrical shield.

10. A double-shielded electroluminescent panel, comprising:

an upper electrical shield being a transparent conductive film with a contact grounded;

a lower electrical shield being a conductive film with a contact grounded;

an electroluminescent device interposed between the upper electrical shield and the lower electrical shield, the electroluminescent device being capable of emitting luminescent rays through the upper electrical shield; and, first and second flexible vibration buffers interposed between the electroluminescent device and the upper and lower electrical shields, respectively.

11. The double-shielded electroluminescent panel of claim 10, wherein the first buffer is a sponge or a rubber.

12. The double-shielded electroluminescent panel of claim 10, wherein the first and second buffers are flexible adhesives.

13. The double-shielded electroluminescent panel of claim 10, wherein the second buffer is a sponge or a rubber.

14. The double-shielded electroluminescent panel of claim 10, wherein the electroluminescent device is a substantially planar light source.

15. The double-shielded electroluminescent panel of claim 10, further comprising a signboard, wherein the electroluminescent panel backlights the signboard.

16. A shielding apparatus for an electroluminescent light having a plurality of electrodes and an illuminating surface being capable of emitting luminescent rays responsively to application of an electrical potential across the plurality of electrodes, said apparatus comprising:

a first electrical shield including a first grounded and substantially transparent conductor layer; and a second electrical shield including a second grounded conductor layer;

wherein, the electroluminescent light is interposed between the first and second electrical shields such that at least some of the luminescent rays emitted from the illuminating surface pass through the first electrical shield; and first and second flexible vibration buffers interposed between the electroluminescent device and the first and second electrical shields, respectively.

17. The apparatus of claim 16, wherein the first and second shields are both electrically coupled to a ground line of an electrical power source or grounded directly.

18. The apparatus of claim 16, wherein the first and second shields are both electrically connected to a metal shell body of a vehicle or a large-scale machine.

19. The apparatus of claim 16, wherein the second conductor comprises a thin metal plate.

20. The apparatus of claim 16, wherein the second conductor comprises a silver paste layer or a carbon paste layer.

21. The apparatus of claim 20, wherein the silver paste layer or the carbon paste layer is coated or printed on the electroluminescent light.

22. The apparatus of claim 16, wherein the first conductor comprises an ITO or an organic conductive high polymer.

23. The apparatus of claim 16, wherein the first electrical shield further includes a transparent protection layer.

24. The apparatus claim 16, wherein the second electrical shield further includes an isolator.

25. The apparatus of claim 16, wherein the first buffer is a sponge or a rubber.

26. The apparatus of claim 16, wherein the first and second buffers are flexible adhesives.

27. The apparatus of claim 16, wherein the first buffer is transparent.

28. The apparatus of claim 16, wherein the second buffer is a sponge or a rubber.

29. The apparatus of claim 16, wherein the electroluminescent light is a substantially planar light.

30. The apparatus of claim 16, further comprising a signboard, wherein the electroluminescent light backlights the signboard.

31. The apparatus of claim 16, wherein the electroluminescent device includes an insulation layer that provides the illuminated surface.

32. The double-shielded electroluminescent panel of claim 10, wherein the electroluminescent device comprises an upper insulation layer, a front electrode layer, a fluorescence layer, a back electrode layer and a lower insulation layer.

* * * * *